US008365340B2

(12) United States Patent
Barstad et al.

(10) Patent No.: US 8,365,340 B2
(45) Date of Patent: Feb. 5, 2013

(54) MULTIPURPOSE TOOL WITH MOVEABLY ARRANGED PLATES

(76) Inventors: Gary Alan Barstad, Deephaven, MN (US); Michael Allen Mochinski, Ramsey, MN (US)

( * ) Notice: Subject to any disclaimer, the term of this patent is extended or adjusted under 35 U.S.C. 154(b) by 1017 days.

(21) Appl. No.: 12/291,191

(22) Filed: Nov. 7, 2008

(65) Prior Publication Data

US 2009/0113647 A1 May 7, 2009

Related U.S. Application Data

(60) Provisional application No. 61/002,236, filed on Nov. 7, 2007.

(51) Int. Cl.
*B43L 21/00* (2006.01)

(52) U.S. Cl. ..... 15/210.1; 15/209.1

(58) Field of Classification Search ..... 15/210.1, 15/105, 235.7, 235.8, 231, 208, 209.1; 451/522, 451/524, 514
See application file for complete search history.

(56) References Cited

U.S. PATENT DOCUMENTS

| | | | | |
|---|---|---|---|---|
| 684,576 | A | 10/1901 | Lucas | |
| 1,370,060 | A | 3/1921 | Smith | |
| 2,402,069 | A * | 6/1946 | Minnick et al. | 451/514 |
| 2,817,931 | A | 12/1957 | Houser | |
| 2,824,443 | A | 2/1958 | Ames | |
| 3,279,130 | A | 10/1966 | Nelson | |
| 4,619,013 | A | 10/1986 | Yon | |
| 4,774,789 | A | 10/1988 | Amalfi | |
| 5,544,384 | A | 8/1996 | Forselius et al. | |
| 5,690,547 | A | 11/1997 | Holland, Jr. et al. | |
| 5,718,622 | A * | 2/1998 | Jones | 451/524 |
| 6,325,708 | B1 | 12/2001 | Miles | |
| 7,653,961 | B2 * | 2/2010 | Probasco | 15/220.1 |

* cited by examiner

*Primary Examiner* — Robert Scruggs
(74) *Attorney, Agent, or Firm* — Michael A Mochinski

(57) ABSTRACT

A multipurpose tool for cleaning, sanding, abrading, scrubbing, finishing, and polishing a work surface orientated in an angular or coplanar manner, which comprises a body having a top face and left and right sides integrally associated with leftward and rightward runners, respectively, for mounting thereon a pair of movably arranged plates in three distinct positional arrangements. Each leftward and rightward runner comprises a bottom face situated in between inward and outward angular walls each being angularly orientated within a specified range. Each movably arranged plate comprises a beveled edge correlating to a select angular orientated value of the outward and inward angular walls and first and second planar surfaces affixed with a hook and loop fastener to accept thereon an interchangeable surface element appropriately suited to operate on the work surface, the tool further comprising strap members attached to the body to engage one's hand to permit secure handling thereof.

21 Claims, 14 Drawing Sheets

MULTIPURPOSE TOOL WITH MOVEABLY ARRANGED PLATES

CROSS-REFERENCE TO RELATED APPLICATIONS

This application claims the benefit of U.S. Provisional Patent Application No. 61/002,236, filed Nov. 7, 2007, entitled "Multipurpose Tool with Movably Arranged Plates," the disclosures of which, including all attached documents, are incorporated herein by reference in their entirety for all purposes.

FIELD OF THE INVENTION

The present invention generally relates to a multipurpose tool equipped with a pair of movably arranged plates that can be selectively arranged and positioned in either an angular or coplanar manner and adaptably accept a variety of interchangeable surface elements each having particular and unique characteristics to finish, clean, sand, paint, scrub, abrade, and polish an equally configured work surface.

BACKGROUND OF THE INVENTION

A variety of tools exist in the art for which are directed to accomplishing numerous tasks in the workplace and in areas of a household. Some tools, particularly those offered and used in the construction trade, for example, are directed to installing, preparing and finishing a variety of materials generally present in and incorporated into a residential or commercial structure, materials of which may include sheetrock, wood, plaster, and concrete. In the instance of installing and preparing sheetrock for finishing, a trade person, commonly known in the art as a sheetrock hanger or drywaller, may utilize a variety of manually and electrically operated tools, including common items such as a hammer, a utility knife, and a square for preparing the sheetrock for installation and an electric screw gun for driving specially configured screws inwardly into and through the sheetrock for secure attachment to framing members of a building structure. Once the sheetrock has been properly placed and anchored to the framing member to complete the structural aspects of a wall, drywall finishers, as commonly known in the trade, prepare the sheetrock for finishing, which generally includes filling in all anchoring screw locations and sealing all abutting ends of the sheeting rock present along corners and planar surfaces of the wall with a joint compound or a plasticized material. In most applications, a paper strip or tape is used in conjunction with the joint compound to control shrinkage at and reinforce the strength of the sheetrock joint for a seamless appearance. Once the paper tape and joint compound additive have been properly placed and secured to the sheetrock joint with joint compound, generally being applied by means of a taping machine or a banjo designed to hold and contain the joint compound for select, layered addition to the paper tape, and cured for a predetermined amount of time, generally to the manufacture's specifications, additional layers of joint compound are applied to smooth and even the finish of the sheetrock joint. In this instance of application, the drywall finisher, depending on his or her level of skill, may simply utilize a pan and knife for working the joint compound by hand to achieve the desired leveled appearance or use a manually operated tool that is specifically configured to contain and selectively dispense the joint compound onto the wall surface in a layered, uniform manner without the undue requirement of hand working the joint compound. In most sheetrock installations, joint compound may be re-applied after a set curing period to build up the sheetrock joint and screw locations to a sufficient level to permit further finishing of the sheetrock if deemed necessary.

After layering the joint compound to an acceptable level by the methodologies noted above, the drywall finisher generally undertakes a further step in the sheetrock finishing process, namely the removal of minute layered amounts of excess joint compound by means of a sanding device. This step further ensures the surficial blending of the sheetrock joint and each screw location with the planar surfaces of the sheetrock. Typical sanding devices or tools directed to accomplishing this step and offered in the art mainly operate under the principle of moving back and forth or vibrating a sanding element generally affixed to a plate and made movable by means of a motor or a person's hand. Manually operated sanding devices, such as those that are configured to fit within one's hand or palm or operate from afar using an extension pole, rely on most part on the user's trained eye and hand dexterity to achieve the desired leveled effect. The art offers a varied range of manually operated sanding devices, including those that simply comprise a foam block with angular or pitched sides covered or encased with a grit-like material or a more advanced form in the nature of a fixed planar or angular element affixed with a handle on one side and a rubber backing on the backside thereof to accept a removable sandpaper sheet and the like. An example of a fixed corner sander for addressing an exterior corner is illustrated in U.S. Pat. No. 4,774,789 issued to Amalfi and entitled "Corner Sander." Devices in this classification tend to be used by both the novice and the professional given their simplicity of use, low cost, and availability. However, many of these types of devices inherently lack a capability to conform to differing angle configurations. Other manually operated devices may comprise more advanced features that may enable one to re-configure the planar element to correspond to the angular orientation of the work surface, for example, an inside 90 degree corner. An example of such device is disclosed in U.S. Pat. No. 1,370,060 issued to Smith and entitled "Trowel," which teaches a pair of planar elements hinged together along a common side and connected to handle assembly having adjustable structural supports that allow the planar elements to move from a flattened position to an angular position capable of addressing an inside corner of varying degrees. Although this device allows for adjustability, the angular range is limited to addressing interiorly configured corners and planar surfaces and not necessarily an outside corner.

Accordingly, there remains a need for a device that easily adjusts to inside and outside corners as well as planar surfaces of the type typically found in commercial and residential building structures and possesses the direct capacity to perform operations of finishing, cleaning, sanding, painting, scrubbing, abrading, and polishing a material work surface.

BRIEF SUMMARY OF THE INVENTION

In order to overcome the numerous drawbacks apparent in the prior art, a multipurpose tool has been devised for cleaning, sanding, abrading, scrubbing, painting, finishing, and polishing a material work surface.

It is an object of the present invention to provide a multipurpose tool that readily adapts to and comfortably fits a person's hand to mitigate occurrences of fatigue and stress during prolong use thereof.

It is an object of the present invention to provide a multipurpose tool that is readily capable of conforming to a material work surface that is orientated in an angular or coplanar manner.

It is yet another object of the present invention to provide a multipurpose tool that is solidly and rigidly constructed to offer reliable, long-term performance.

It is another object of the present invention to provide a multipurpose tool that comprises a lesser number of components and no moving parts to which effectively contributes to a lesser cost of manufacture and reduced susceptibility of failure.

It is another object of the present invention to provide a multipurpose tool that can readily accept on a temporal basis a variety of interchangeable surface elements each being appropriately suited to clean, sand, abrade, scrub, finish, and polish a material work surface.

It is yet another object of the present invention to provide a multipurpose tool that can be conveniently stowed along with other tools and carried to a workplace.

It is yet another object of the present invention to provide a multipurpose tool which accomplishes the foregoing and other objects and advantages and which is economical, durable, and fully effective in performing its intended functions.

In accordance with the present invention a multipurpose tool has been devised for cleaning, sanding, abrading, scrubbing, finishing, and polishing a material work surface that is orientated in an angular or coplanar manner, the multipurpose tool principally comprising a body having a top face and left and right sides integrally associated with leftward and rightward runners, respectively, for receiving and mounting thereon a pair of movably arranged plates in three distinct positional arrangements to coincide and conform with the orientation of the material work surface, the leftward and rightward runners each comprising a bottom face situated in between inward and outward angular walls each being angularly orientated within a specified range, the movably arranged plates each comprising first and second edges of equal length and a beveled edge having a pitched face with a predetermined angular value, preferentially correlating to the select angular orientated value of the outward and inward angular walls and first and second planar surfaces each being selectively configured to receive and mount thereon a hook and loop fastener sufficiently sufficing as means for attaching an interchangeable surface element that is appropriately suited to work or operate on the material work surface in the preferential manner noted herein, the multipurpose tool further comprising primary and secondary strap members attached to the left and right sides of the body, principally serving to engage and encompass a person's hand to permit secure handling thereof while working on the material work surface.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE INVENTION

While this invention is susceptible of being embodied in many different forms, the preferred embodiment of the invention is illustrated in the accompanying drawings and described in detail hereinafter with the understanding that the present disclosure purposefully exemplifies the principles of the present invention and is not intended to unduly limit the invention to the embodiments illustrated and presented herein. The present invention has particular utility as a manually, hand-operated device having the capabilities of adapting to the positional orientation of a material work surface to effectuate one's effort in cleaning, sanding, abrading, scrubbing, painting, finishing, and polishing the material work surface in an efficient manner.

Figure 1:
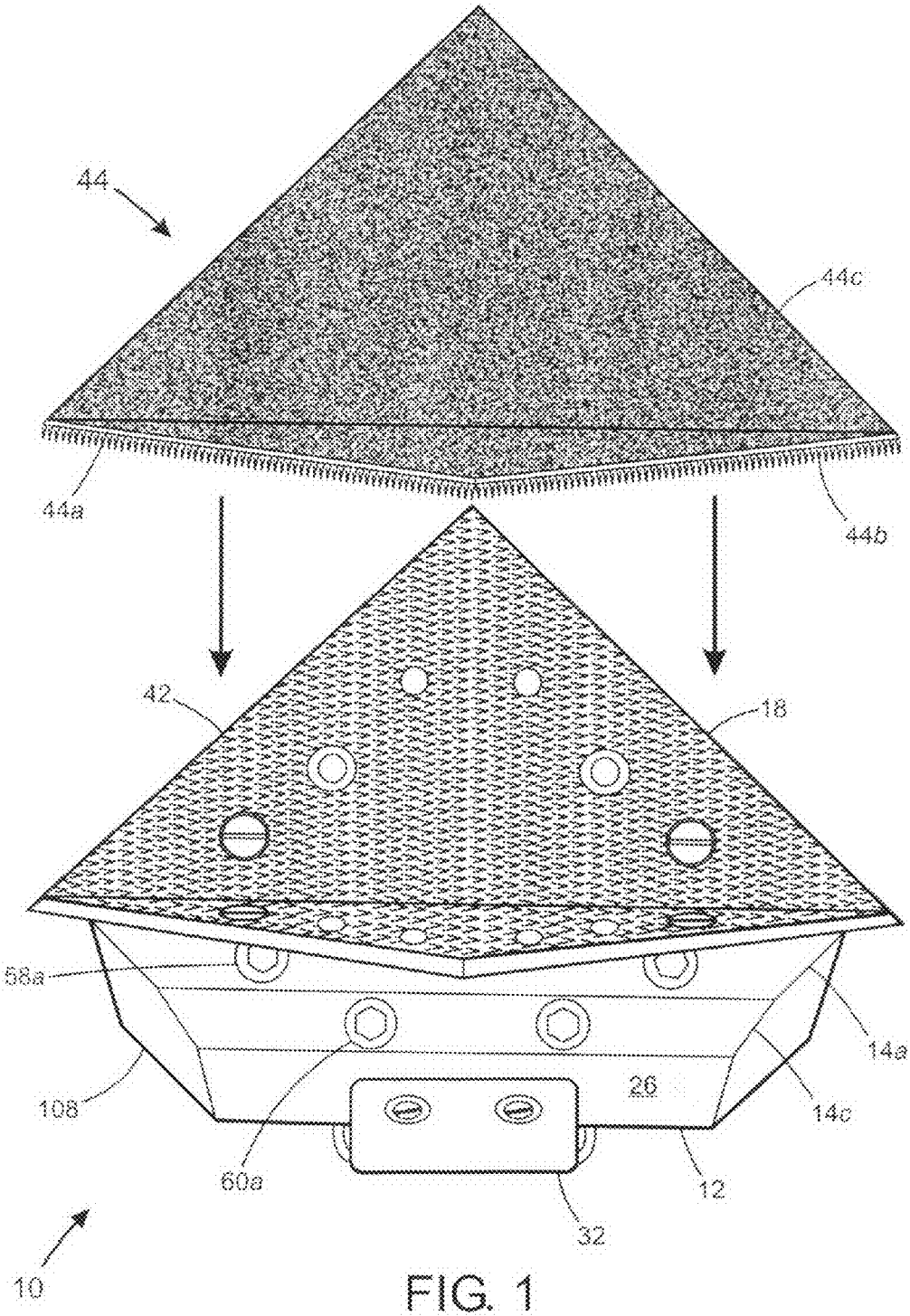
FIG. 1 is a side perspective view of the preferred embodiment of the present invention illustrating a body mounted with a pair of movably arranged plates suited to receive an interchangeable surface element.
Figure 2:
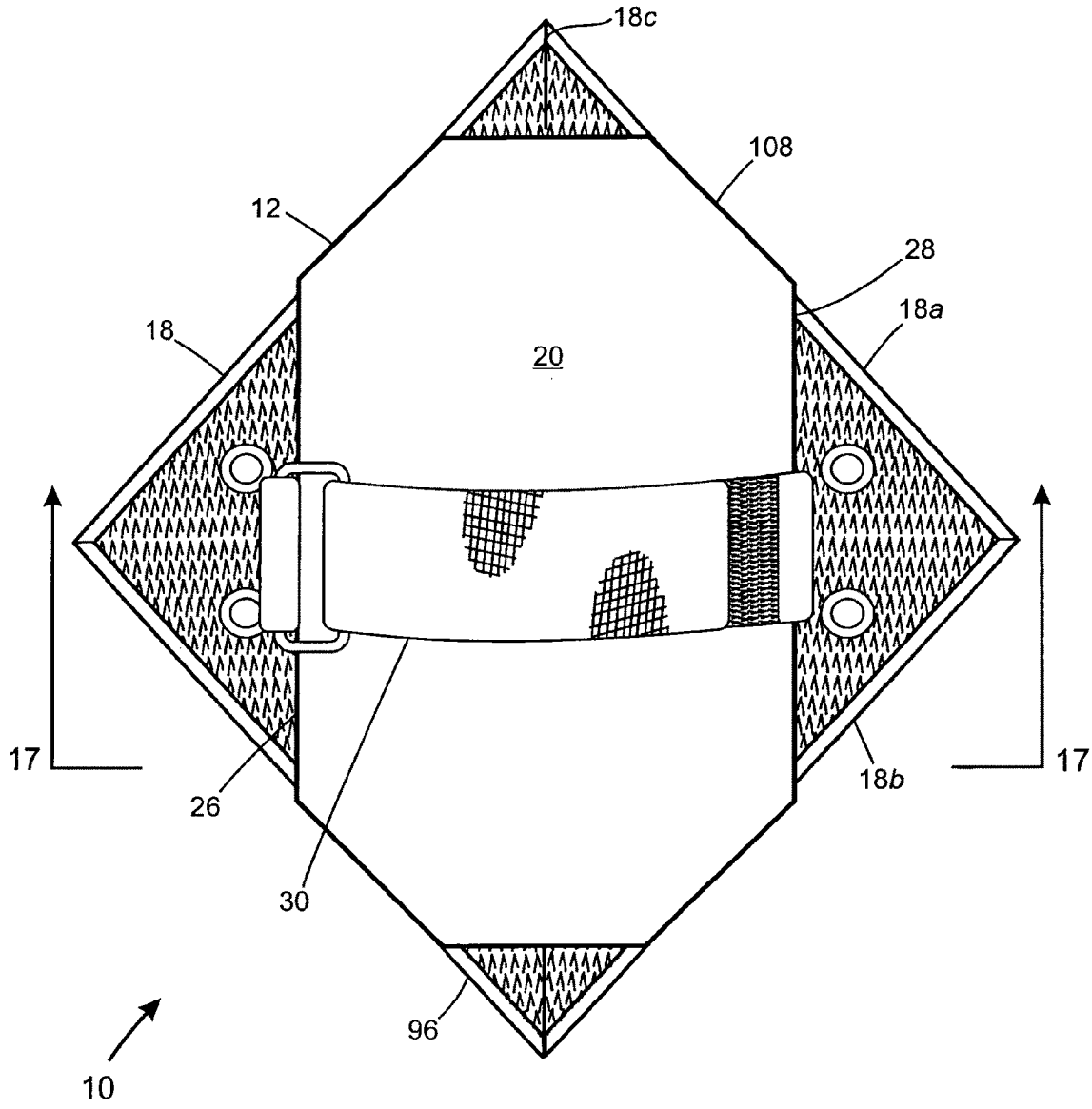
FIG. 2 is a top plan view of the preferred embodiment of the present invention illustrating a body mounted with primary and secondary strap members and a pair of movably arranged plates angularly orientated to address an outside-configured corner.
Figure 3:
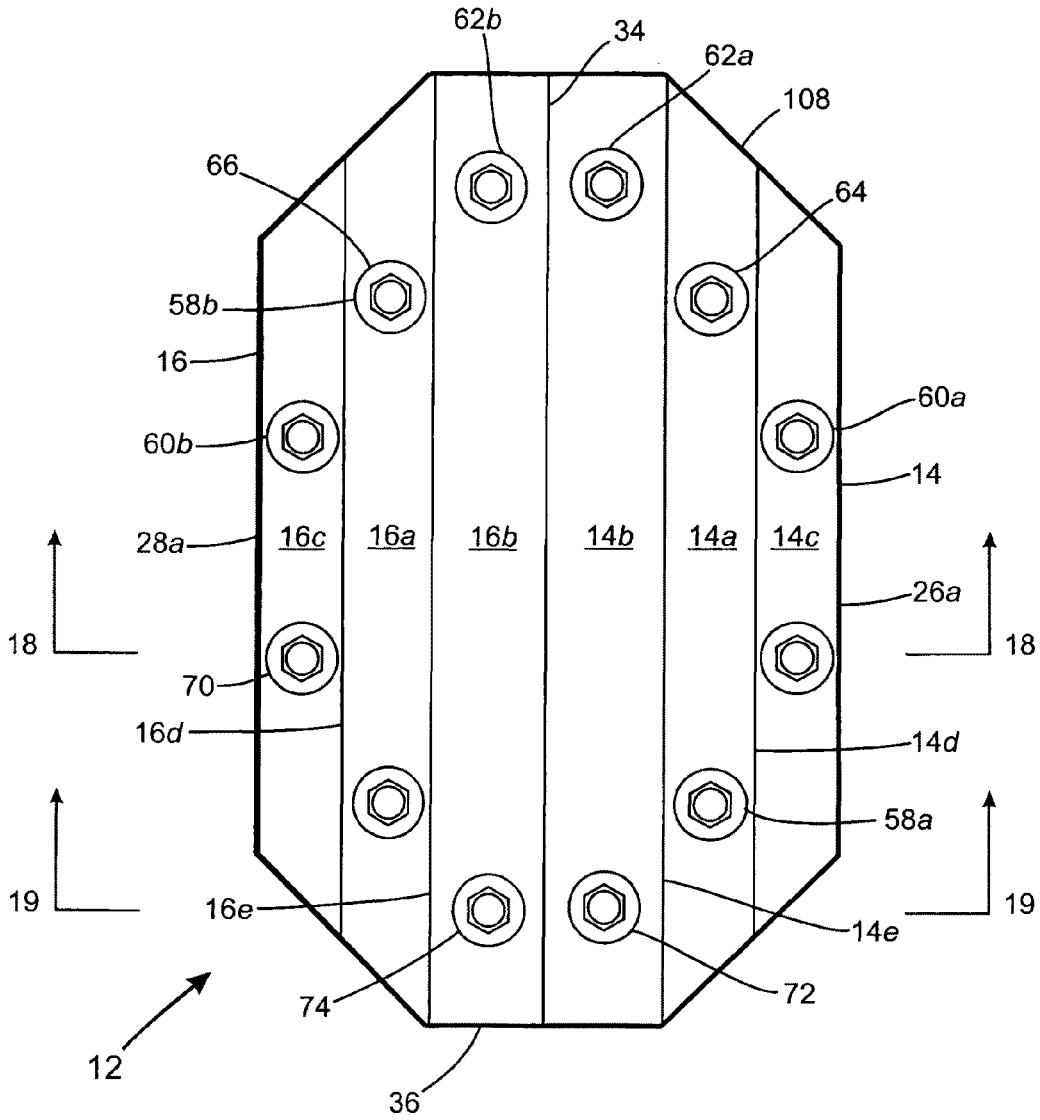
FIG. 3 is a bottom plan view of the preferred embodiment of the present invention illustrating a body equipped with sockets each fitted with a screw insert.
Figure 4:
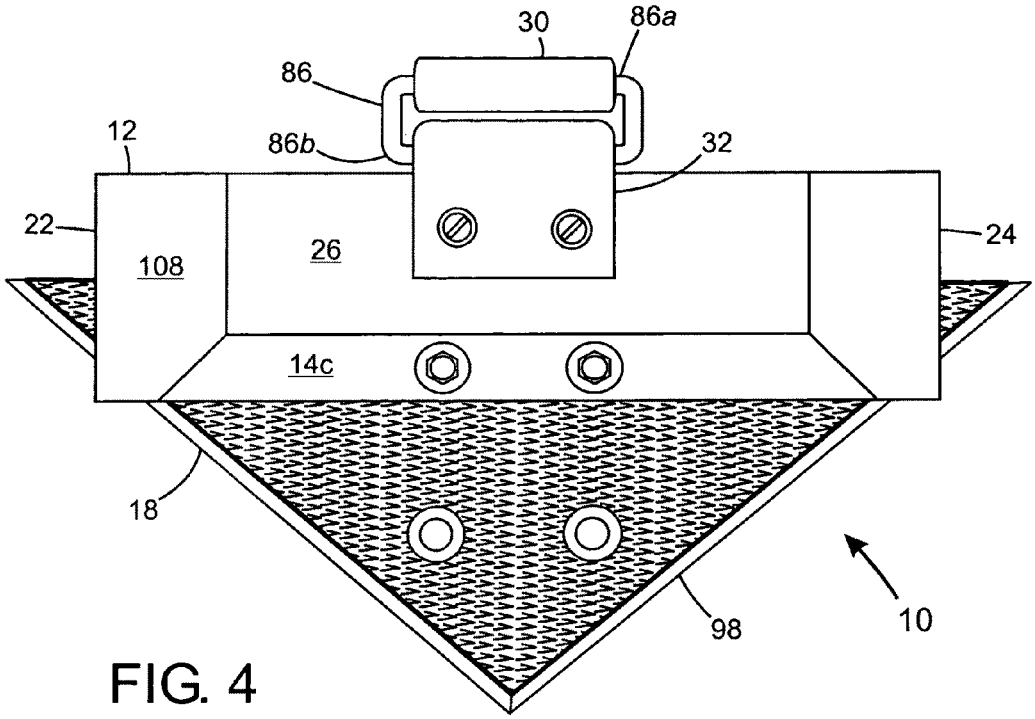
FIG. 4 is a left side elevational view of the preferred embodiment of the present invention illustrating a leftward runner of a body mounted with a movably arranged plate angularly orientated to address an exterior angular working surface.
Figure 5:
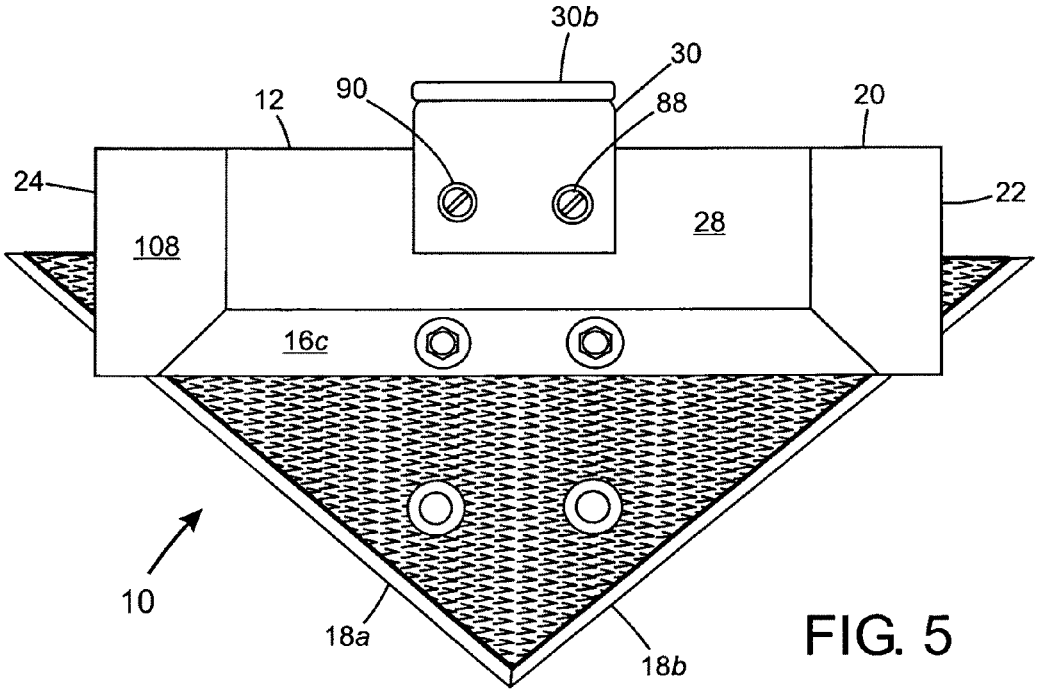
FIG. 5 is a right side elevational view of the preferred embodiment of the present invention illustrating a rightward runner of a body mounted with a movably arranged plate angularly orientated to address an exterior angular working surface.
Figure 6:
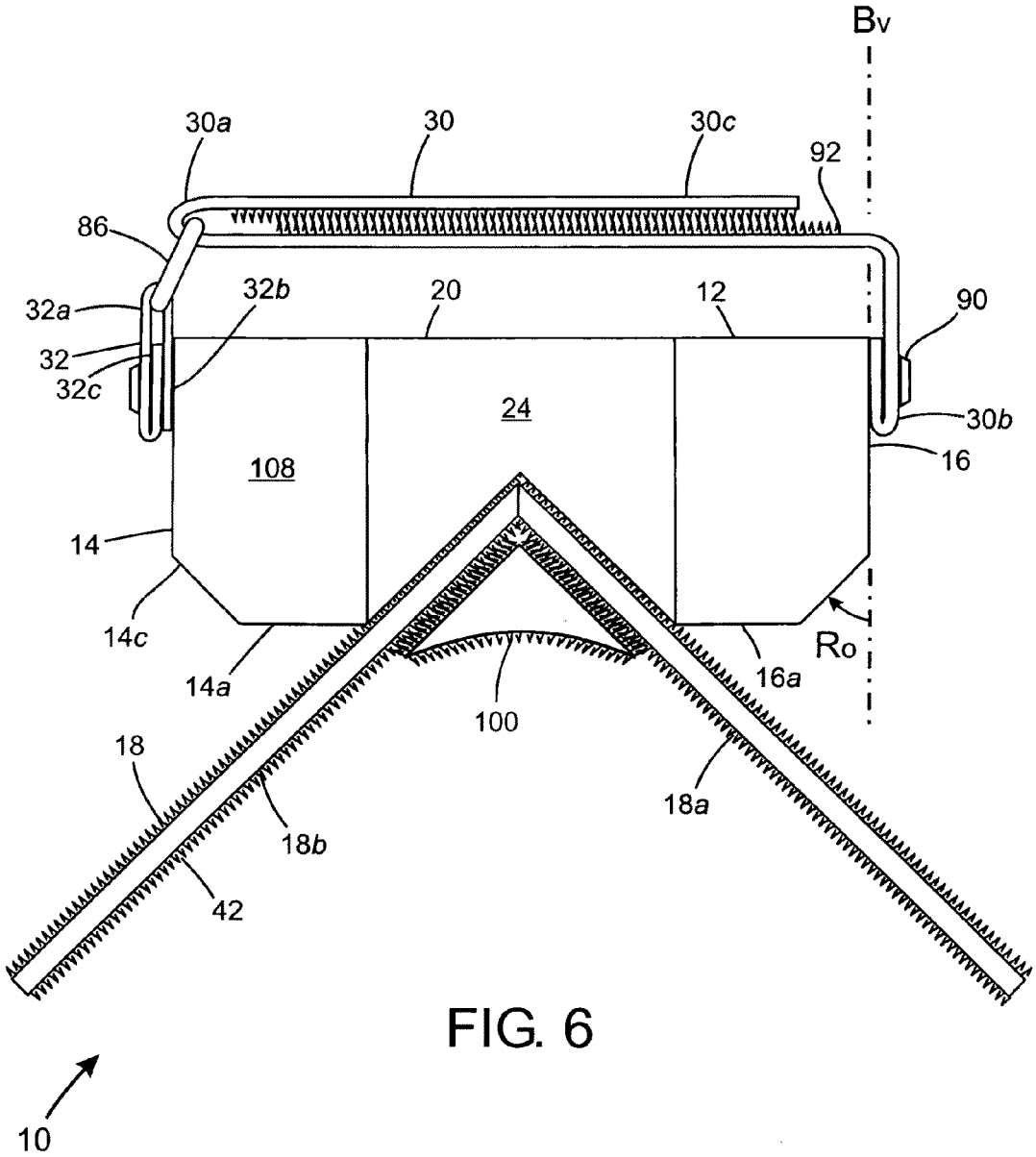
FIG. 6 is an end view of the preferred embodiment of the present invention illustrating a body mounted with primary and secondary strap members and a pair of movably arranged plates angularly orientated to address an exterior angular working surface.
Figure 7:
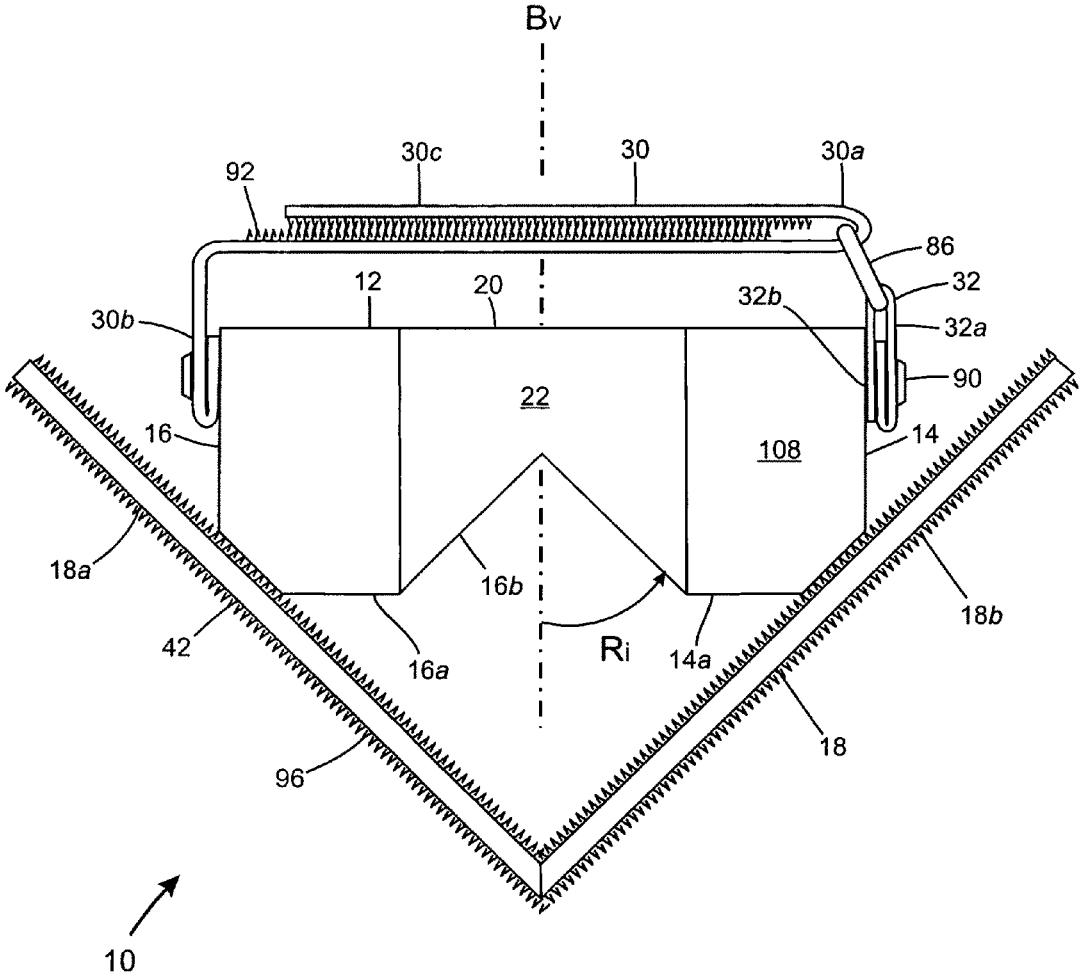
FIG. 7 is an end view of the preferred embodiment of the present invention illustrating a body mounted with primary and secondary strap members and a pair of movably arranged plates angularly orientated to address an interior angular working surface.

Referring now to FIG. 1, there is shown generally at 10 a multipurpose tool comprising a body 12 having integral leftward and rightward runners 14, 16 for receiving and mounting thereon a pair of movably arranged plates 18 in three distinct positional arrangements to coincide and conform with the orientation of a material work surface. The body in particular is illustrated in FIGS. 2 and 3 to comprise a top face 20, front and back sides 22, 24 each preferentially orientated perpendicular to the top face, and left and right sides 26, 28 each being integrally associated with the leftward and rightward runners, respectively. Each of the leftward and rightward runners, as shown in FIG. 3, is symmetrical in form with one another and comprise a bottom face 14*a*, 16*a* situated in between inward and outward angular walls 14*b*, 16*b*, 14*c*, 16*c* and generally orientated parallel to the top face 20 of the body. The left and right sides each comprise a lower leading edge 26*a*, 28*a* extending lengthwise about the body, substantially parallel to each of the leftward and rightward runners 14, 16, respectively. Each of the outward angular walls of the leftward and rightward runners is generally shown in FIG. 3 as being bounded by the lower leading edge of the left and right sides of the body, respectively, and an outward edge 14*d*, 16*d* of the respective bottom face 14*a*, 16*a*. As depicted in FIGS. 4 and 5, the lower leading edge is preferably located approximately two-third distance from the top face 20 to principally establish a sufficient area on each of the left and right sides to mount thereon primary and secondary strap members 30, 32, respectively, and allow one to grasp the body 12 comfortably without undue hindrance from the strap members while operating the multipurpose tool 10 in the preferred manner noted herein. Similarly, each of the inward angular walls of the leftward and rightward runners is generally shown in FIG. 3 as being bounded by a common apex 34 extending lengthwise about the body and an inward edge 14*e*, 16*e* of the respective bottom face 14*a*, 16*a*. The resultant positioning of the inward angular walls of the leftward and rightward runners in association with the common apex foundationally establishes and defines a v-shaped channel 36 substantially situated therein-between and extending lengthwise about the body 12, parallel to the lower leading edges. As illustrated in FIGS. 6 and 7, the angular orientation of the outward and inward angular walls relative to a vertical axis $B_v$ extending perpendicular to the top face 20 of the body is primarily determined and dictated by the orientation of and necessity to work the material work surface in the most efficient and preferred manner. Accordingly, each of the outward and inward angular walls of the leftward and rightward runners is angularly orientated within a specified range $R_o$, $R_i$ of 35 to 50 degrees relative to $B_v$ defined above, a range of which satisfactorily meets or conforms to most angular orientations of the material work surface observed in industry and elsewhere. Regardless of the angular orientation selected from within the specified range $R_o$, $R_i$, the outward and inward angular walls each preferentially comprise an angular orientation equivalent in value.

Figure 8:
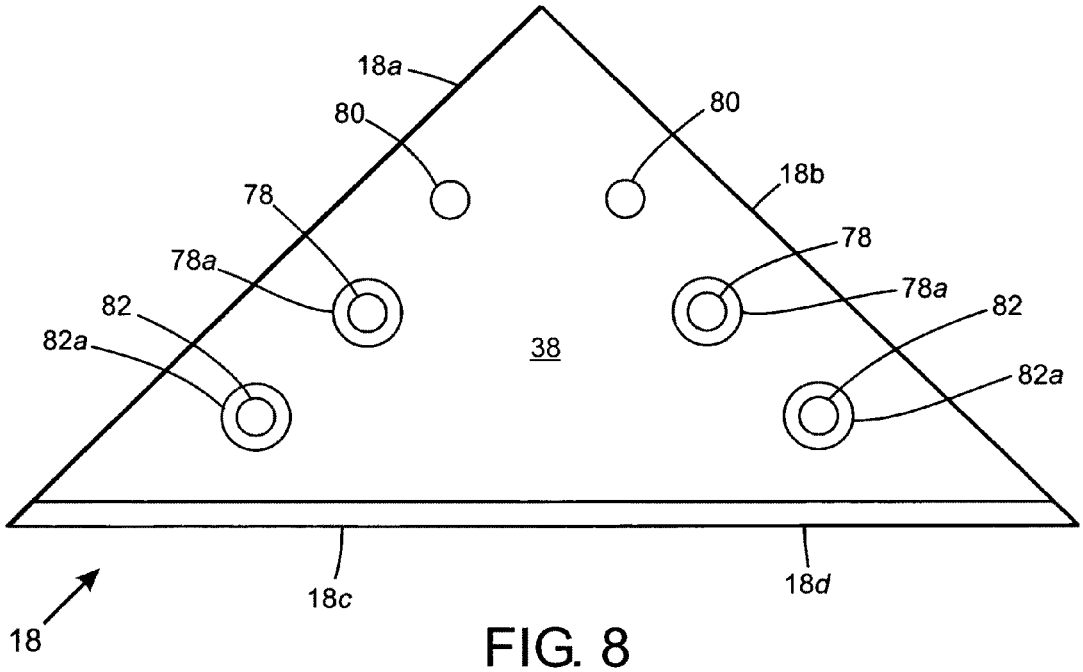
FIG. 8 is a top plan view of the preferred embodiment of the present invention illustrating a movably arranged plate having a first planar surface and plate apertures extending therethrough to receive an equal number of flat head screws.
Figure 9:
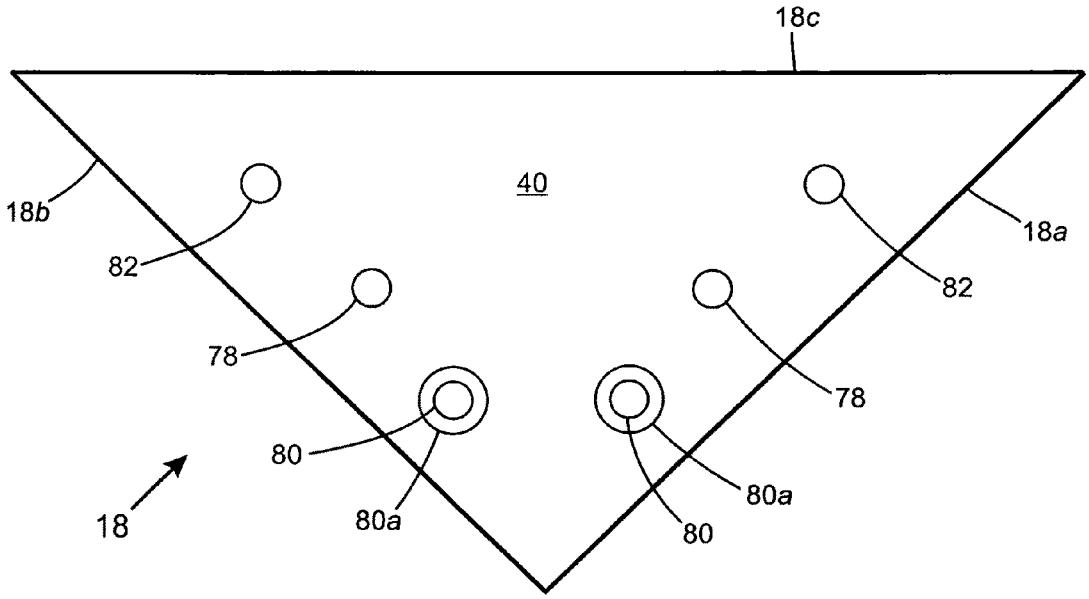
FIG. 9 is a bottom plan view of the preferred embodiment of the present invention illustrating a movably arranged plate having a second planar surface and plate apertures extending therethrough to receive an equal number of flat head screws.

FIGS. 8 and 9 illustrate a preferred geometric configuration of the movably arranged plate that sufficiently yields efficient workability of the material work surface, namely one being geometrically configured as a triangle. Each movably arranged plate 18 is further shown to comprise first and second edges 18*a*, 18*b* of equal length and a beveled edge 18*c* having a pitched face 18*d* with a predetermined angular value, preferentially correlating to the select angular orientated value of the outward and inward angular walls within the above-noted specified range $R_o$, $R_i$. Other geometric configurations of the movably arranged plate may be appropriate for unique applications, such as one configured as a semi-circle or a rectangle (both not shown). A choice between alternative configurations of the movably arranged plate may be primarily dictated by the type and orientation of the material work surface. With this understanding, the description of the movably arranged plate in terms of its preferred triangular form principally serves to illustrate its purpose and functionality with the body 12, and not unduly limit the present invention as described herein. Further shown in FIG. 10, each of the movably arranged plates comprises first and second planar surfaces 38, 40 each configured to receive and mount thereon a hook and loop fastener 42, particularly of the type commonly known in the art and commercially available under the tradename Velcro®. The hook and loop fastener in this strict application primarily serves as means for attaching a variety of interchangeable surface elements 44 each of which comprising a backside 44*a* fitted with a hook and loop fastener 44*b* and a top layer 44*c* appropriately suited to work or operate on the material work surface, such as those directed to cleaning, sanding, scraping, abrading, scrubbing, painting, finishing, and polishing the material work surface. It is duly noted herein that other available, known means in the art for attaching the interchangeable surface elements to the movably arranged plates 18 may be suited in this application, such as an adhesive in lieu of the preferred hook and loop fastener.

Figure 11:
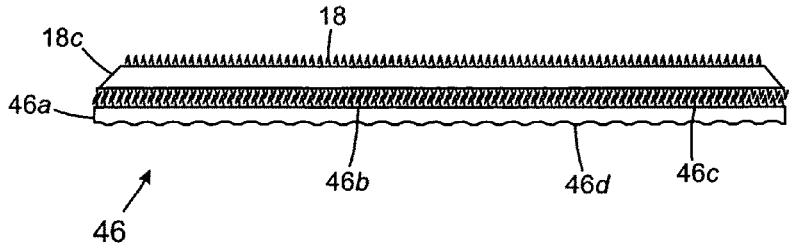
FIG. 11 is a side elevational view of the preferred embodiment of the present invention illustrating an interchangeable surface element having an abrading layer and attached to a movably arranged plate having a beveled edge.
Figure 12:
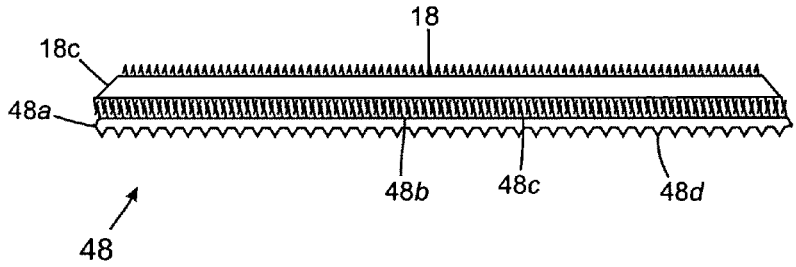
FIG. 12 is a side elevational view of the preferred embodiment of the present invention illustrating an interchangeable surface element having a grating layer and attached to a movably arranged plate having a beveled edge.
Figure 13:
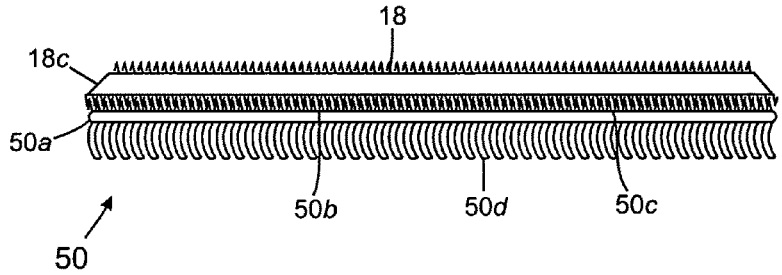
FIG. 13 is a side elevational view of the preferred embodiment of the present invention illustrating an interchangeable surface element having a filament layer and attached to a movably arranged plate having a beveled edge.
Figure 14:
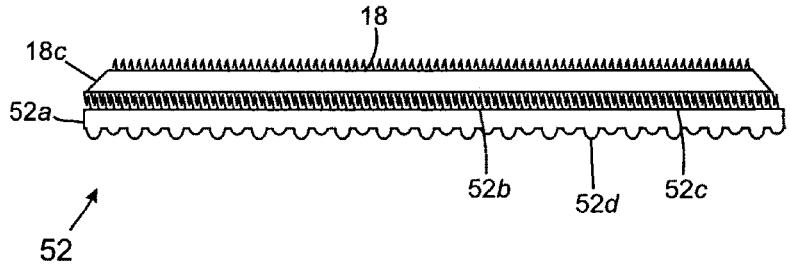
FIG. 14 is a side elevational view of the preferred embodiment of the present invention illustrating an interchangeable surface element having a granulating layer and attached to a movably arranged plate having a beveled edge.
Figure 15:
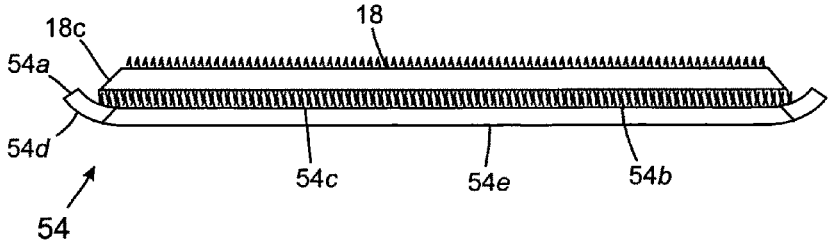
FIG. 15 is a side elevational view of the preferred embodiment of the present invention illustrating an interchangeable surface element having a planar layer and attached to a movably arranged plate having a beveled edge.
Figure 16:
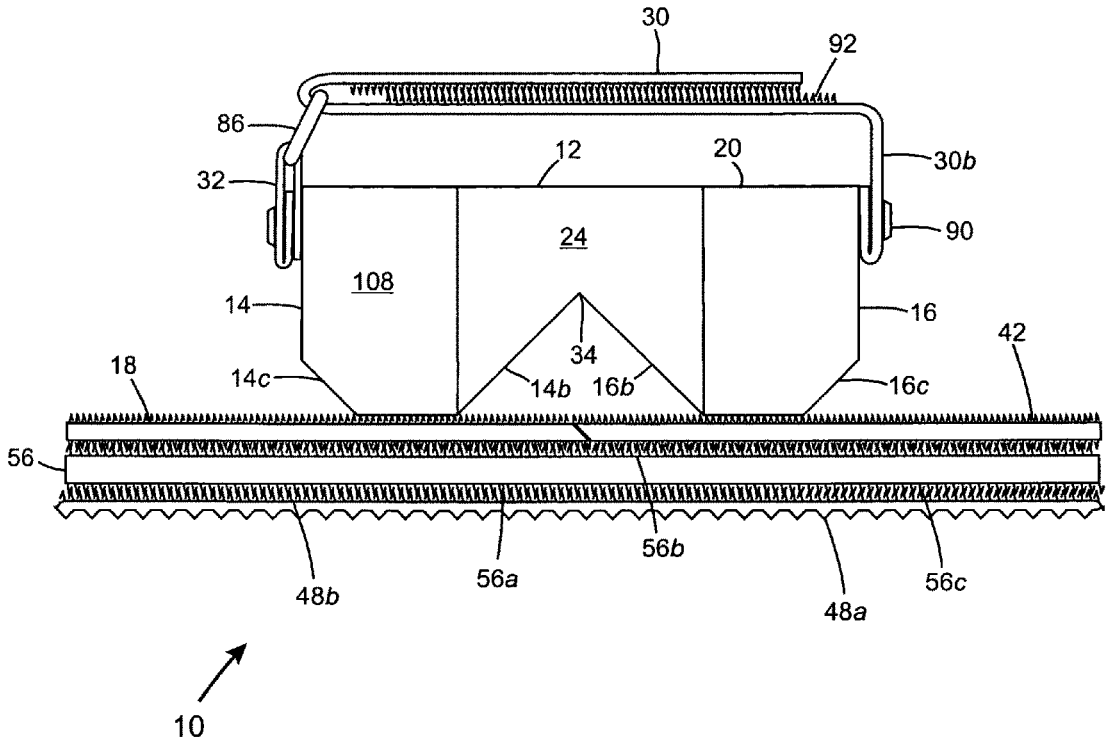
FIG. 16 is an end view of the preferred embodiment of the present invention illustrating a body mounted with a pair of movably arranged plates orientated in a planar manner for receiving atop thereof an intermediate layer followed with an interchangeable surface element suited to scrap a material work surface.

FIGS. 11 through 15 illustrate profiles of a variety of interchangeable surface elements 44 that may be appropriately attached to the movably arranged plates to allow one to work the material work surface in the specific manner discussed herein. FIG. 11 shows in particular the movably arranged plate configured with an abrading interchangeable surface element 46 comprising a top abrading layer 46*a* and a backside 46*b* affixed with a hook and loop fastener 46*c*. The top abrading layer in this instance may comprise an undulated metallic surface 46*d* or equivalent having durable properties to abrade or scrub a material work surface having a density range of low to moderate, such as soft wood, foam, composite or fibrous board, plaster, and the like. FIG. 12 shows the movably arranged plate alternatively configured with a grating interchangeable surface 48 element comprising a top grating layer 48*a* and a backside 48*b* affixed with a hook and loop fastener 48*c*. The top grating layer in this instance may comprise a plurality of protruding, converging elements 48*d* sufficiently configured to scrape a material work surface having a density range of moderate to high, such as hard wood, cementitious or rock board, cinder block, and the like. FIG. 13 shows the movably arranged plate alternatively configured with a filament interchangeable surface element 50 comprising a top filament layer 50*a* and a backside 50*b* affixed with a hook and loop fastener 50*c*. The top filament layer in this instance may comprise a plurality of flexible fibrous elements 50*d* sufficiently configured to clean, paint, and polish the material work surface. FIG. 14 shows the movably arranged plate alternatively configured with a granulating interchangeable surface element 52 comprising a top granulating layer 52*a* and a backside 52*b* affixed with a hook and loop fastener 52*c*. The top granulating layer in this instance may comprise a plurality of small, irregularly-shaped pieces of aggregate 52*d*, equivalent to that used to fabricate a variety of sandpaper types, sufficiently of which removes minute amounts of surface material from the material work surface, generally to a lesser degree than that of the abrading layer noted above. Finally, FIG. 15 shows the movably arranged plate alternatively configured with a planar interchangeable surface element 54 comprising a top planar layer 54*a* and a backside 54*b* affixed with a hook and loop fastener 54*c*. The planar layer in this instance may comprise upwardly extending edges 54*d* to permit unhindered operation and a smooth, planar surface element 54*e* sufficiently configured to smooth over or finish the material work surface, such as in the operation of spreading and layering joint compound, paste, concrete, mastic, and like materials. In all representations of the interchangeable surface elements noted above, it is preferred that the interchangeable surface element comprise a unified structure sufficiently of which is sized, folded, bent, or shaped to conform to the size and shape of the pair of movably arranged plates 18 as mounted to and arranged on the leftward and rightward runners 14, 16, substantially as illustrated in FIGS. 1 and 16. It is further noted that other material types or alternative configurations of the interchangeable surface element may be possible other than those described herein by way of example. For instance, the interchangeable surface element may comprise a combination or variation of the above to yield further workability of the material work surface. In some instances, it may be desired or deemed necessary to incorporate in between the movably arranged plate and the interchangeable surface element an intermediate layer 56 having foam-like qualities or properties, principally of which allows the interchangeable surface element to flex upon applied hand pressure and adaptably conform to the undulations and contours of the material work surface. The intermediate layer, as shown in FIG. 16, preferably comprises back and front sides 56*a*, 56*b* each being fixedly attached with a hook and loop fastener 56*c* to permit temporary, simultaneous attachment to both the movably arranged plate and the interchangeable surface element.

Figure 10:
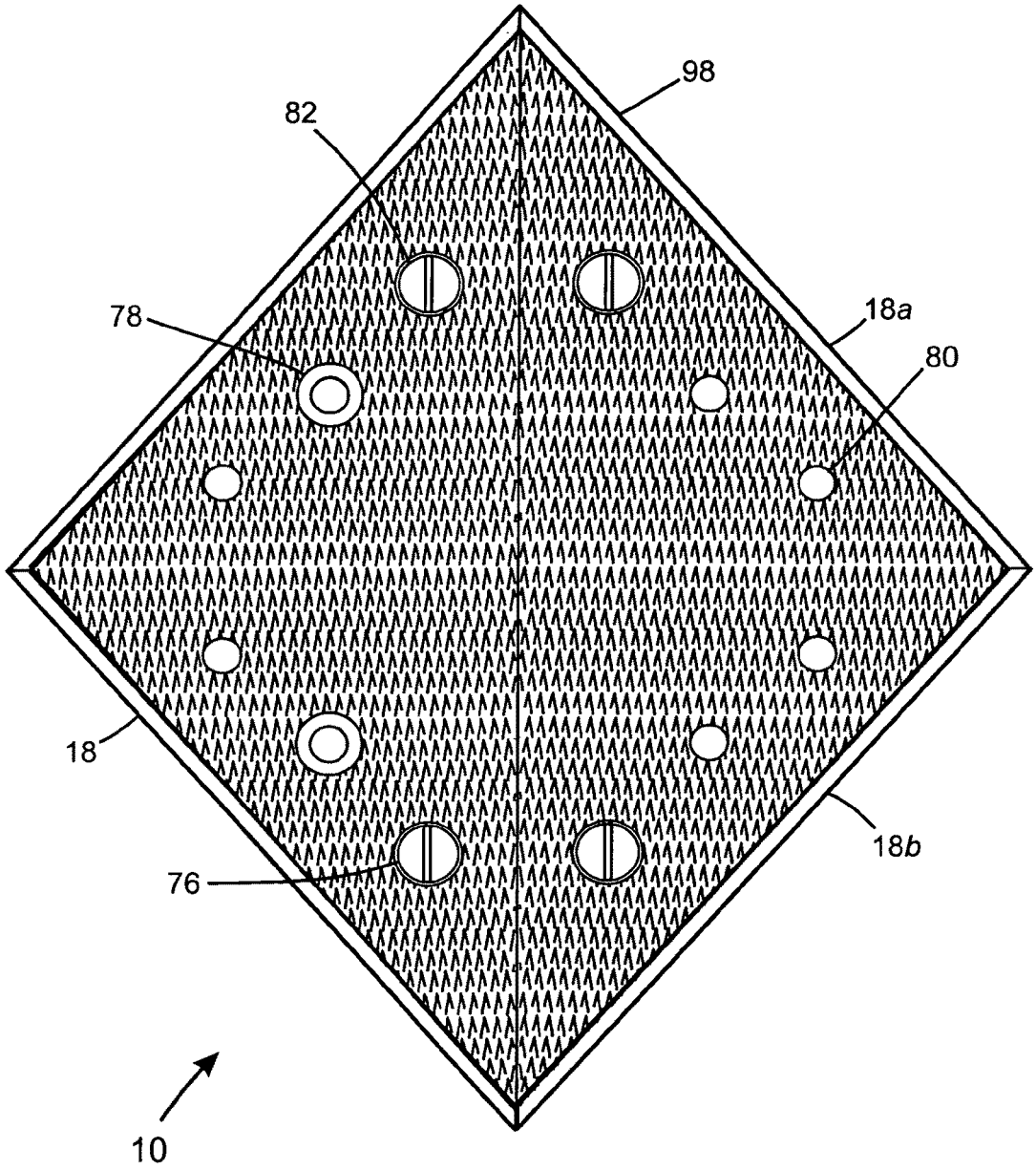
FIG. 10 is a bottom plan view of the preferred embodiment of the present invention illustrating a body mounted with a pair of movably arranged plates angularly orientated to address an exterior angular working surface.
Figure 17:
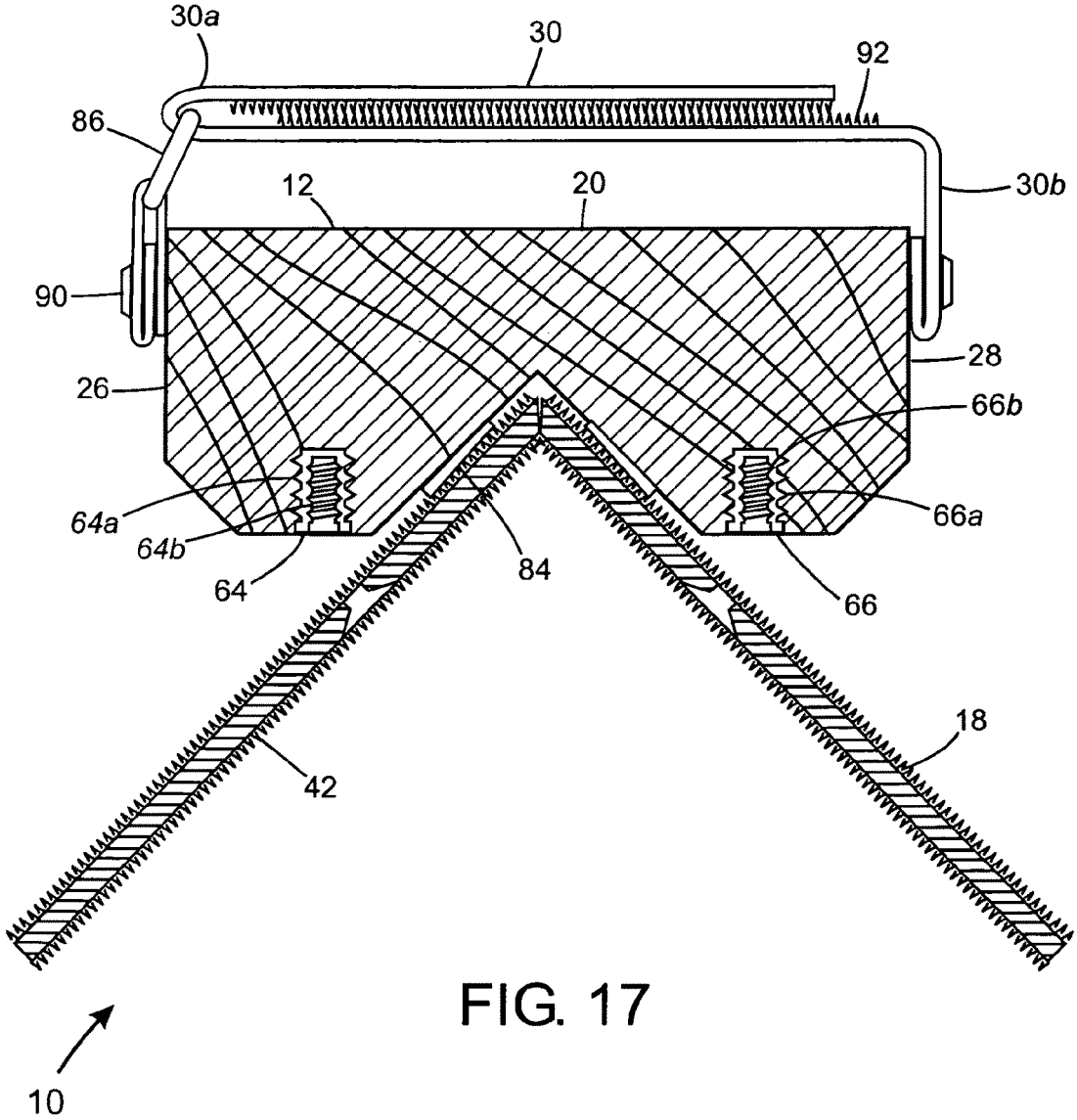
FIG. 17 is a cross sectional view of the preferred embodiment of the present invention taken along lines 17-17 in FIG. 2 illustrating a body mounted with a pair of movably arranged plates angularly orientated to address an outside-configured corner and a pair of screw inserts each suited to receive a flat head screw.
Figure 18:
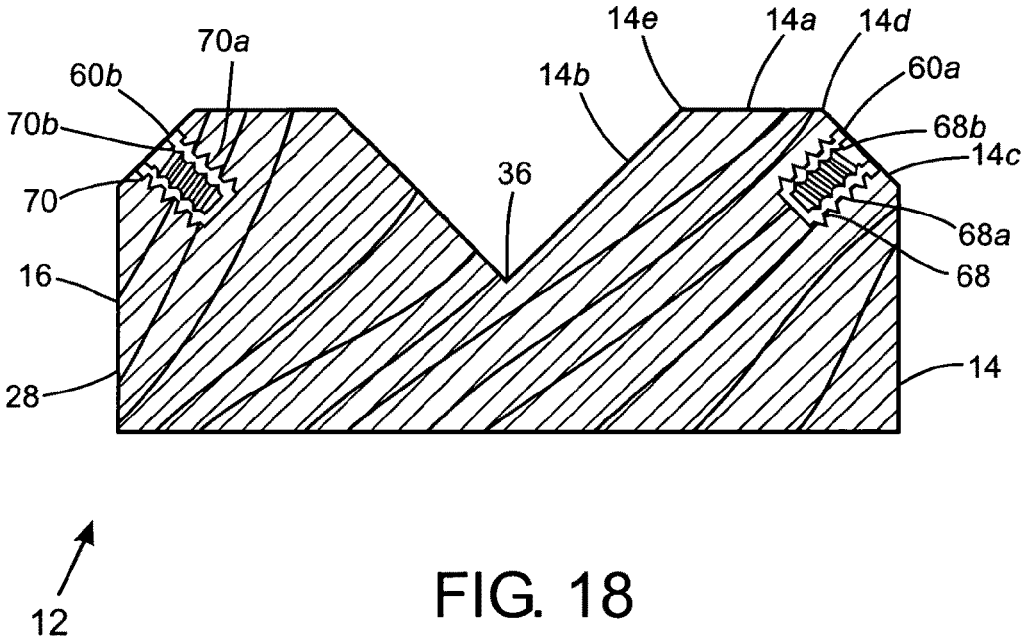
FIG. 18 is a cross sectional view of the preferred embodiment of the present invention taken along lines 18-18 in FIG. 3 illustrating a body comprising screw inserts embedded in outward angular walls of leftward and rightward runners.
Figure 19:
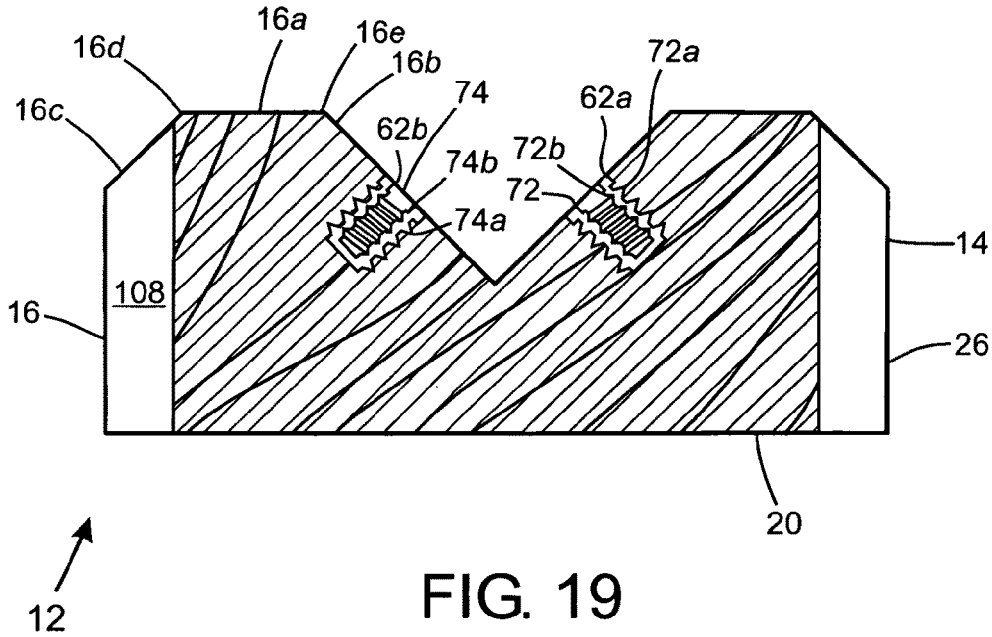
FIG. 19 is a cross sectional view of the preferred embodiment of the present invention taken along lines 19-19 in FIG. 3 illustrating a body comprising screw inserts embedded in inward angular walls of leftward and rightward runners.
Figure 20:
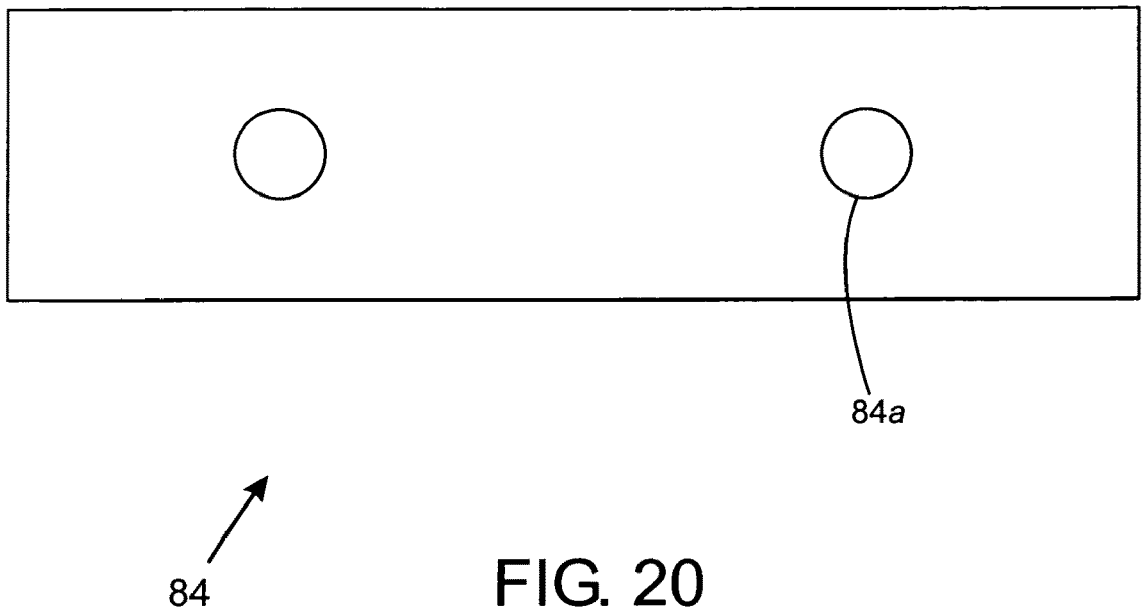
FIG. 20 is a top plan view of the preferred embodiment of the present invention illustrating a tapered shim having one or more apertures extending therethrough.
Figure 21:
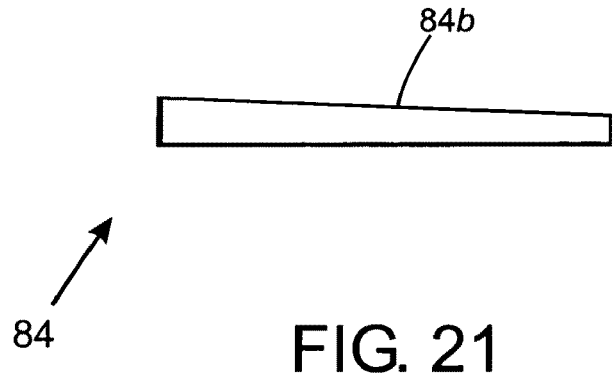
FIG. 21 is a side elevational view of the preferred embodiment of the present invention illustrating a tapered shim having a tapered side.

Referring now to FIG. 3, the leftward and rightward runners of the body 12 are further shown in association with means for connecting the movably arranged plates 18 in three positional arrangements to the runners. In the preferred embodiment, connecting means comprises in part first, second, and third sets of sockets 58*a*, 58*b*, 60*a*, 60*b*, 62*a*, 62*b* extending inwardly into the bottom face and outward and inward angular walls of the leftward and rightward runners, respectively, with each socket being fitted with a self-tapping screw insert 64, 66, 68, 70, 72, 74 of the type noted in the art to comprise external threads 64*a*, 66*a*, 68*a*, 70*a*, 72*a*, 74*a* to threadably engage the sidewalls of the socket and internal threads 64*b*, 66*b*, 68*b*, 70*b*, 72*b*, 74*b* to threadably accept a flat head screw 76 having a beveled head 76*a*, as shown in FIGS. 17 through 19. Connecting means is further associated with first, second, and third sets of plate apertures 78, 80, 82 extending through each movably arranged plate 18 which sufficiently yields the passage of the flat head screw therethrough to threadably engage with the internal threads of the self-tapping screw insert. In order to mitigate interference with the beveled head of the flat head screw, each plate aperture comprises a beveled portion 78*a*, 80*a*, 82*a* to the extent that a top portion 76*b* of the beveled head sits or lays flush with the planar surface of the movably arranged plate, as shown in FIG. 10. In some instances, it may be appropriate or required to minutely adjust the angular orientation of the movably arranged plates 18 to effectuate full contact of the interchangeable surface element 44 with the material work surface. In this regard, one or more tapered shims 84, each having a tapered side 84*b*, may be positioned in between the movably arranged plate and either the bottom face or inward or outward angular wall, particularly in the manner shown in FIG. 6. One or more apertures 84*a* may extend through the tapered shim to receive therethrough the flat head screw 76 to hold the shim securely in its preferred position, as substantially shown in FIGS. 20 and 21. It is noted herein that connecting means may comprise any number of the methodologies known in the art other than the combined arrangement of flat head screws and self-tapping screw inserts. For example, it may be appropriate in some cases to connect each of the movably arranged plates to the bottom face and outward and inward angular walls of the leftward and rightward runners 14, 16 by means of a hook and loop fastener, such as the type commonly known in the art and offered under the tradename Velcro® or simply by means of a semi-permanent adhesive.

As shown in FIG. 2, the body 12 is further associated with means for securing the multi-purpose tool to one's hand to permit manual workability of the material work surface, preferentially comprising a rectangular-shaped ring 86 having upper and lower elongate portions 86*a*, 86*b* and primary and secondary strap members 30, 32 each having a midsection 30*a*, 32*a* and first and second ends 30*b*, 32*b*, 30*c*, 32*c*. The secondary strap member is shown in FIG. 4 as passing interiorly through the rectangular-shaped ring, with the first and second ends thereof being held together and fixedly connected to the right side of the body by means of strap screws 82 situated within an equal number of concave washers 90 and the midsection of the secondary strap member 32 being positioned to wrappingly engage around the lower elongate portion 86*b*. Likewise, the primary strap member 30 is shown in FIG. 6 as passing interiorly through rectangular-shaped ring 86, with the first end thereof being fixedly connected to the left side of the body by means of strap screws 88 situated within an equal number of concave washers 90. The midsection of the primary strap member is shown generally to wrappingly engage around the upper elongate portion 86*a*, with the second end of the primary strap member 30 being semi-permanently attached to a select portion of the primary strap member by means of a hook and loop fastener 92.

FIGS. 6, 7 and 16 illustrate three select positional arrangements of the movably arranged plates on the leftward and rightward runners to coincide with the positional orientation of the material work surface.

In the first positional arrangement, as shown in FIG. 16, the movably arranged plates are connected to the bottom face of the leftward and rightward runners 14, 16 to yield a planar working surface 94, wherein the first set of plate apertures 78 in each movably arranged plate is used and selectively aligned with a corresponding first set of sockets 58*a*, 58*b* fitted with screw inserts present in the bottom face. FIG. 16 further illustrates the correct manner in which the pair of movably arranged plates is orientated and positioned on the bottom face 14*a*, 16*a*, specifically where the first set of plate apertures observed with the beveled portion is facing outward to receive the beveled head of the flat head screw and the beveled edges 18*c* of the movably arranged plates are oppositely orientated to overlap and abut with one another.

In the second positional arrangement, as shown in FIG. 7, the movably arranged plates are connected to the outward angular walls 14*c*, 16*c* of the leftward and rightward runners to yield an interior angular working surface 96, wherein the second set of plate apertures 80 in each movably arranged plate is used and selectively aligned with a corresponding second set of sockets 60*a*, 60*b* fitted with screw inserts present in the outward angular walls. FIG. 7 further illustrates the correct manner in which the pair of movably arranged plates is orientated and positioned on the outward angular walls 14*c*, 16*c*, specifically where the second set of plate apertures observed with the beveled portion is facing outward to receive the beveled head 76*a* of the flat head screw and the beveled edges of the movably arranged plates are similarly orientated to abut up against with one another.

Figure 22:
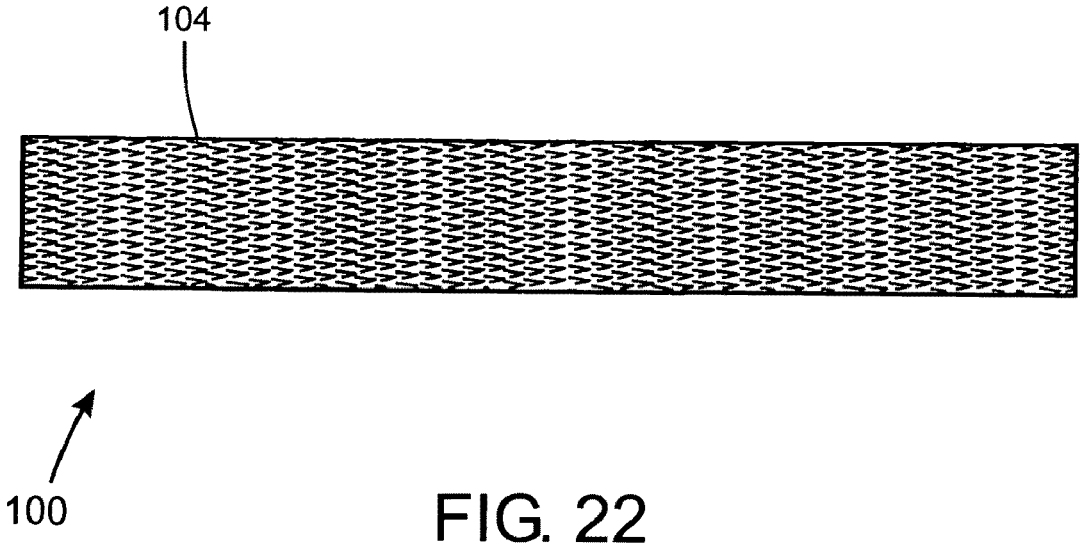
FIG. 22 is a side elevational view of the preferred embodiment of the present invention illustrating a bullnose insert.
Figure 23:
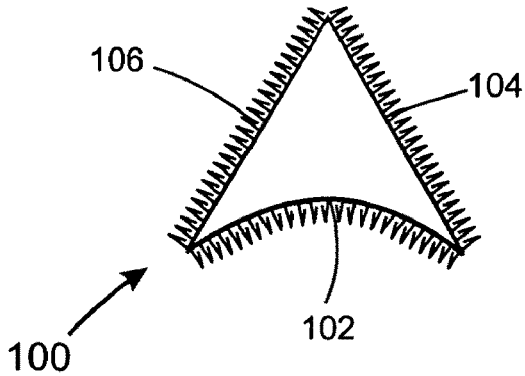
FIG. 23 is an end view of the preferred embodiment of the present invention illustrating a bullnose insert.

In the third and final positional arrangement, as shown in FIG. 6, the movably arranged plates are connected to the inward angular walls 14*b*, 16*b* of the leftward and rightward runners to yield an exterior angular working surface 98, wherein the third set of plate apertures 82 in each movably arranged plate is used and selectively aligned with a corresponding third set of sockets 62*a*, 62*b* fitted with screw inserts present in the inward angular walls. FIG. 6 further illustrates the correct manner in which the pair of movably arranged plates is orientated and positioned on the inward angular walls 14*b*, 16*b*, specifically where the third set of plate apertures observed with the beveled portion is facing outward to receive the beveled head of the flat head screw 76 and the beveled edges 18*c* of the movably arranged plates are similarly orientated to abut up against with one another near the common apex 34. In order to meet the requirements of an exterior angular working surface generally having a rounded appearance, a bullnose insert 100 may be placed where the movably arranged plates converge together near the v-shaped channel 36, as illustrated in FIG. 6. The bullnose insert, as shown in FIGS. 22 and 23, preferably comprises a convex side 102 having an inward rounded appearance that is generally orientated to face outward toward the exterior angular working surface to conform therewith and a pair of sides 104 of equal width that generally rest up against the first and second planar surfaces of the movably arranged plates. The two sides of equal width and convex side each receive hook and loop fasteners 106 to secure their position on the movable arranged plates 18 and to accept the interchangeable surface element, respectively.

It can be seen from the foregoing that there is provided in accordance with this invention a simple and easily operated device, which is particularly capable of adapting to the positional orientation of a material work surface to effectuate one's effort in cleaning, sanding, abrading, scrubbing, painting, finishing, and polishing the material work surface in an efficient manner. In offering greater versatility and maneuverability in confined areas where one must work or operate on the material work surface, the body 12 may comprise a plurality of angular corners 108 that principally function to limit the extent to which the body extends beyond the movably arranged plates 18 when each is mounted onto the leftward and rightward runners 14, 16.

It is obvious that the components comprising the multipurpose tool 10 may be fabricated from a variety of materials, providing such selection or use of materials possess the capacity to withstand forces acting thereon throughout its duration of use in a commercial or residential setting. Accordingly, it is most desirable, and therefore preferred, to construct the body 12 of the multipurpose tool 10 from wood or equivalent to offer ease in machinability thereof and the movably arranged plates from aluminum or equivalent to yield sufficient structural support for the interchangeable surface elements 44 while operating on the material work surface. To lessen the cost and simplify construction of the multipurpose tool and enable use thereof in a moisture-laden environment, the body may comprise a unified structure fabricated from plastic or equivalent, preferentially being formed into its desired shape by technological means of plastic injection molding.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention.

What is claimed is:

1. A multipurpose tool having three distinct positional arrangements for operating on an equally configured work surface, said tool comprising, in combination:

a body having a top face, front and back sides, and left and right sides;

leftward and rightward runners each associated with and integrally connected to said left and right sides, respectively, and having a bottom face situated in between outward and inward angular walls each having a fixed angular relation relative to said bottom face;

a pair of moveably arranged plates selectively configured for detachment from and connection to either said bottom face, inward angular wall, or outward angular wall of leftward and rightward runners to correspond with and conform to the configured work surface;

means for connecting said moveably arranged plates to either said bottom face, inward angular wall, or outward angular wall of leftward and rightward runners;

an interchangeable surface element selectively situated and orientated atop said moveably arranged plates to operate on the configured work surface; and means for attaching said interchangeable surface element to said moveably arranged plates.

2. A multipurpose tool as set forth in claim 1, wherein said connecting means comprises first, second, and third sets of sockets extending inwardly into said bottom face and said outward and inward angular walls of leftward and rightward runners, respectively, with each of said sockets being fitted with a self-tapping screw insert for threadably accepting therewithin a flat head screw and each of said moveably arranged plates comprises first, second, and third sets of plate apertures extending therethrough to permit passage of said flat head screw and substantially aligning with either said first, second, or third sets of sockets, respectively, to establish an orientation of said moveably arranged plates corresponding with and conforming to the configured work surface.

3. A multipurpose tool having three distinct positional arrangements for operating on an equally configured work surface, said tool comprising, in combination:

a body having a top face, front and back sides, and left and right sides;

a pair of moveably arranged plates each having first and second planar surfaces affixed with a hook and loop fastener and first, second, and third sets of plate apertures extending therethrough to permit passage of flat head screws;

leftward and rightward runners each associated with and integrally connected to said left and right sides of body, respectively, and having a bottom face situated in between outward and inward angular walls with each having a set of sockets fitted with self-tapping screw inserts selectively aligning with either said first, second, or third sets of plate apertures, respectively, to establish an orientation of said moveably arranged plates corresponding with and conforming to the configured work surface; and an interchangeable surface element having a backside affixed with a hook and loop fastener to permit attachment with said first and second planar surfaces of moveably arranged plates and a top layer selectively suited to operate on the configured work surface.

4. A multipurpose tool as set forth in claim 3, further comprising primary and secondary strap members each having a midsection and first and second ends, said secondary strap member being arranged to pass through a rectangular-shaped ring substantially near the midsection thereof with said first and second ends thereof being held together and fixedly connected to said right side of body by strap screws, said primary strap member being arranged to pass through said rectangular-shaped ring substantially near said midsection thereof with said first end thereof being fixedly connected to said left side of body by strap screws and said second end thereof being semi-permanently attached to a select portion of primary strap member by a hook and loop fastener.

5. A multipurpose tool having three distinct positional arrangements for operating on an equally configured work surface, said tool comprising, in combination:

a body having a top face, front and back sides, and left and right sides;

a pair of moveably arranged plates of triangular form each having at least one beveled edge and first and second planar surfaces affixed with a hook and loop fastener and first, second, and third sets of plate apertures extending therethrough to permit passage of flat head screws;

leftward and rightward runners each associated with and integrally connected to said left and right sides of body, respectively, and having a bottom face situated in between outward and inward angular walls with each having a set of sockets fitted with self-tapping screw inserts selectively aligning with either said first, second, or third sets of plate apertures, respectively, to establish an orientation of said moveably arranged plates corresponding with and conforming to the configured work surface;

an interchangeable surface element having a backside affixed with a hook and loop fastener to permit attachment with said first and second planar surfaces of moveably arranged plates and a top layer selectively suited to operate on the configured work surface; and primary and secondary strap members each having a midsection and first and second ends, said secondary strap member being arranged to pass through a rectangular-shaped ring substantially near the midsection thereof with said first and second ends thereof being held together and fixedly connected to said right side of body by strap screws, said primary strap member being arranged to pass through said rectangular-shaped ring substantially near said midsection thereof with said first end thereof being held together and fixedly connected to said left side of body by strap screws and said second end thereof being semi-permanently attached to a select portion of primary strap member by a hook and loop fastener.

6. A multipurpose tool as set forth in claim 5, further comprising one or more tapered shims each having a tapered side and one or more apertures extending therethrough to receive said flat head screw to hold said tapered shim securely in between said moveably arranged plate and either about said bottom face or inward or outward angular wall of leftward and rightward runners to minutely adjust the angular orientation of said moveably arranged plates.

7. A multipurpose tool having three distinct positional arrangements for operating on an equally configured work surface, said tool comprising, in combination:

a body having a top face, front and back sides, and left and right sides;

leftward and rightward runners each associated with and integrally connected to said left and right sides, respectively, and having a bottom face situated in between outward and inward angular walls;

a pair of moveably arranged plates selectively situated and orientated atop of either said bottom face, inward angular wall, or outward angular wall of leftward and rightward runners to correspond with and conform to the configured work surface;

first, second, and third sets of sockets extending inwardly into said bottom face and said outward and inward angular walls of leftward and rightward runners, respectively, with each of said sockets being fitted with a self-tapping screw insert for threadably accepting therewithin a flat head screw;

an interchangeable surface element selectively situated and orientated atop said moveably arranged plates to operate on the configured work surface; and means for attaching said interchangeable surface element to said moveably arranged plates.

8. A multipurpose tool as set forth in claim 7, wherein each of said moveably arranged plates comprises first and second planar surfaces.

9. A multipurpose tool as set forth in claim 8, wherein said attaching means comprises a hook and loop fastener fixedly attached to said first and second planar surfaces.

10. A multipurpose tool as set forth in claim 9, wherein said interchangeable surface element comprises a backside affixed with a hook and loop fastener for engaging said hook and loop fastener of first and second planar surfaces and a top abrading layer having an undulated metallic surface having durable properties to abrade or scrub the configured work surface having a density range of low to moderate.

11. A multipurpose tool as set forth in claim 9, wherein said interchangeable surface element comprises a backside affixed with a hook and loop fastener for engaging said hook and loop fastener of first and second planar surfaces and a top grating layer having a plurality of protruding, converging elements sufficiently configured to scrape a configured work surface having a density range of moderate to high.

12. A multipurpose tool as set forth in claim 9, wherein said interchangeable surface element comprises a backside affixed with a hook and loop fastener for engaging said hook and loop fastener of first and second planar surfaces and a top filament layer having a plurality of flexible fibrous elements sufficiently configured to clean, paint, and polish the configured work surface.

13. A multipurpose tool as set forth in claim 9, wherein said interchangeable surface element comprises a backside affixed with a hook and loop fastener for engaging said hook and loop fastener of first and second planar surfaces and a top granulating layer having a plurality of small, irregularly-shaped pieces of aggregate sufficiently configured to remove minute amounts of surface material from the configured work surface.

14. A multipurpose tool as set forth in claim 7, wherein each of said moveably arranged plates comprises at least one beveled edge having a pitched face associated with a predetermined angular value.

15. A multipurpose tool as set forth in claim 14, wherein said predetermined angular value corresponds to an angular orientated value of said outward and inward angular walls.

16. A multipurpose tool as set forth in claim 15, wherein said angular orientated value of each outward and inward angular wall ranges from 35 to 50 degrees relative to a vertical axis extending perpendicular to said top face of body and said bottom face of leftward and rightward runners.

17. A multipurpose tool as set forth in claim 7, wherein each of said moveably arranged plates comprises first, second, and third sets of plate apertures extending therethrough to permit passage of said flat head screw and substantially aligning with either said first, second, or third sets of sockets, respectively, to establish an orientation of said moveably arranged plates corresponding with and conforming to the configured work surface.

18. A multipurpose tool as set forth in claim 7, further comprising primary and secondary strap members each having a midsection and first and second ends, said secondary strap member being arranged to pass through a rectangular-shaped ring substantially near the midsection thereof with said first and second ends thereof being held together and fixedly connected to said right side of body by strap screws, said primary strap member being arranged to pass through said rectangular-shaped ring substantially near said midsection thereof with said first end thereof being fixedly connected to said left side of body by strap screws and said second end thereof being semi-permanently attached to a select portion of primary strap member by a hook and loop fastener.

19. A multipurpose tool as set forth in claim 7, wherein each of said moveably arranged plates comprises a geometric shape substantially resembling a triangle having first and second edges of equal length and a beveled edge.

20. A multipurpose tool as set forth in claim 7, further comprising an intermediate layer situated in between said moveably arranged plates and said interchangeable surface element and having foam-like qualities to permit said interchangeable surface element to adaptably conform to the undulations and contours of the configured work surface as pressure is being applied thereto.

21. A multipurpose tool as set forth in claim 7, further comprising a bullnose insert having a convex side generally orientated to face outward toward an exterior angular work surface to conform therewith and a pair of sides of equal width to generally rest up against said moveably arranged plates while each is mounted and attached to said inward angular walls of leftward and rightward runners.

* * * * *